US007093823B2

(12) United States Patent
Sevalie'

(10) Patent No.: US 7,093,823 B2
(45) Date of Patent: Aug. 22, 2006

(54) LIFTING UNIT

(75) Inventor: Franco Sevalie', Verona (IT)

(73) Assignee: ASCOM S.p.A., Formigine (IT)

( * ) Notice: Subject to any disclaimer, the term of this patent is extended or adjusted under 35 U.S.C. 154(b) by 0 days.

(21) Appl. No.: 11/107,955

(22) Filed: Apr. 18, 2005

(65) Prior Publication Data

US 2005/0236608 A1 Oct. 27, 2005

(51) Int. Cl.
*B66D 3/04* (2006.01)

(52) U.S. Cl. ..... 254/337; 254/338; 254/394; 74/89.22

(58) Field of Classification Search ..... 254/335, 254/336, 337, 338, 393, 394; 74/89.22
See application file for complete search history.

(56) References Cited

U.S. PATENT DOCUMENTS 1,507,712 A * 9/1924 Produfoot ..... 254/338
1,785,090 A * 12/1930 Jacoby ..... 254/337
2,463,394 A * 3/1949 King ..... 254/337
2,960,310 A * 11/1960 Hull ..... 254/337
2,994,513 A * 8/1961 Bowerman et al. ..... 254/337
3,805,967 A * 4/1974 Scannell ..... 212/323
4,236,859 A 12/1980 Stearn et al.
4,796,863 A * 1/1989 Reed ..... 254/337
4,861,218 A 8/1989 Lamer et al.
5,207,114 A * 5/1993 Salisbury ..... 74/479.01
5,263,688 A * 11/1993 Krueger ..... 254/337
5,762,279 A * 6/1998 Horton, III ..... 254/285
5,915,906 A * 6/1999 Lucking et al. ..... 414/142.8
6,827,334 B1 * 12/2004 Volle et al. ..... 254/285

FOREIGN PATENT DOCUMENTS

DE 15 06 503 A1 7/1969

* cited by examiner

*Primary Examiner*—Emmanuel M Marcelo
(74) *Attorney, Agent, or Firm*—Albert Josif; Daniel O'Byrne

(57) ABSTRACT

A lifting unit, comprising a frame for supporting a motorized winch, at least one first tackle and one second tackle, the first tackle being interposed between the second tackle and the winch, each tackle being provided with two blocks, a fixed one and a movable one, and each comprising at least one pulley, and a flexible element, with a first end connected to the winch and wound around the pulleys, to form at least one initial loop around the first tackle, an outgoing portion from the first tackle to the second tackle, at least one intermediate loop around the second tackle, a return portion from the second tackle to the first tackle, and at least one end loop around the first tackle, the second end of the flexible element being connected to the frame, and a temporarily locking element for locking sliding of the flexible element.

12 Claims, 1 Drawing Sheet

LIFTING UNIT

The present invention relates to a lifting unit.

BACKGROUND OF THE INVENTION

It is known that devices such as cranes or the like are currently used to lift, move and deposit heavy loads within a specific work area.

These devices are provided with lifting units, which use flexible elements such as cables or chains.

In the nautical field, for example, watercraft are moved in shipyards and at port shores usually by using cranes substantially constituted by a wheeled frame which has a C-shaped plan and by a plurality of motorized lifting units, which are arranged so as to face each other in pairs along the lateral wings of the frame and support the opposite ends of a sling for supporting the watercraft to be moved.

Each lifting unit comprises two tackles arranged in series, each constituted by two blocks, a fixed one and a movable one, with one or more pulleys, around which a flexible element winds, which has a first end that is fixed to a motorized winch and a second end, arranged opposite the first end, which is rigidly coupled to one of the blocks of the tackle that is arranged furthest from the winch.

A load grip element, such as a hook, a sling or others, depending on the type of application for which the lifting unit is intended, is fixed to each movable block.

The elevation of the two movable blocks is independent, so as to allow the lifting unit to adapt to the contour of the load to be moved and balance the load on the various grip elements.

These known lifting units are not free from drawbacks, which are observed in particular in the movement of the movable blocks when empty.

In this step, in order to lift the movable block of the tackle that lies furthest from the winch, which due to friction always moves after the tackle that lies closest to said winch, it is necessary to move the movable block of said tackle to the end of its stroke, with an obvious waste of time on the part of the assigned operators.

Moreover, if the movable blocks of the two tackles are stopped at different levels, due to an uneven distribution of the weight of the flexible elements on said blocks, the lowest block may fall until the other one reaches the end of its stroke, with the risk of injuring operators and/or damaging the objects that are in the work area.

A first known solution for obviating these drawbacks is to provide two winches, on each of which a respective end of the flexible element is wound.

In the portion of the flexible element that connects the two tackles there is a device for temporarily locking the sliding motion, which is activated in order to allow the unladen movements of the two movable blocks to be independent, each movement being actuated by a respective winch.

Even this solution is not free from drawbacks, including the fact that it increases considerably the cost and complexity of the lifting unit and penalizes its operating flexibility and efficiency, in view of the high energy overall energy absorption.

As an alternative, it is known to provide lifting units with mechanical devices that are suitable to temporarily rigidly couple the pulleys of the fixed block of the tackle that lies closest to the winch, simulating the presence of a single loop of flexible element around said first tackle, so as to increase the useful driving torque on the winch and allow the movement of the movable block of the second tackle without having to first move the block of the first tackle to the end of its stroke.

In this case also, there is a device for temporarily locking the temporary sliding of the flexible element arranged along the portion that connects the two tackles, so as to isolate them from each other.

However, this solution requires frequent maintenance and does not ensure optimum and constant performance over time, also in terms of workplace safety.

SUMMARY OF THE INVENTION

The aim of the present invention is to eliminate the above-mentioned drawbacks of the background art, by providing a lifting unit that allows to ensure optimum safety conditions for the operators and for the objects located in the work areas.

Within this aim, an object of the present invention is to be flexible in use and to have constant performance and efficiency over time.

Another object of the present invention is to provide a structure that is simple, relatively easy to provide in practice, safe in use, effective in operation, and has a relatively low cost.

This aim and these and other objects that will become better apparent hereinafter are achieved by the present lifting unit, comprising a frame for supporting a motorized winch, at least one first tackle and one second tackle, said first tackle being interposed between said second tackle and said winch, each tackle being provided with two blocks, a fixed one and a movable one, each comprising at least one pulley, and a flexible element, in which a first end is rigidly associated with said winch and wound around said pulleys, characterized in that said flexible element is wound around said pulleys so as to form at least one initial loop around said first tackle, an outgoing portion from said first tackle to said second tackle, at least one intermediate loop around said second tackle, a return portion from said second tackle to said first tackle, and at least one end loop around said first tackle, the second end of said flexible element being rigidly associated with said frame, means for temporarily locking the sliding of said flexible element being provided which cooperate with said element along said return portion.

BRIEF DESCRIPTION OF THE DRAWINGS

Further characteristics and advantages of the present invention will become better apparent from the following detailed description of a preferred but not exclusive embodiment of a lifting unit, illustrated by way of non-limiting example in the accompanying drawings, wherein.

DESCRIPTION OF THE PREFERRED EMBODIMENTS

Figure 1:
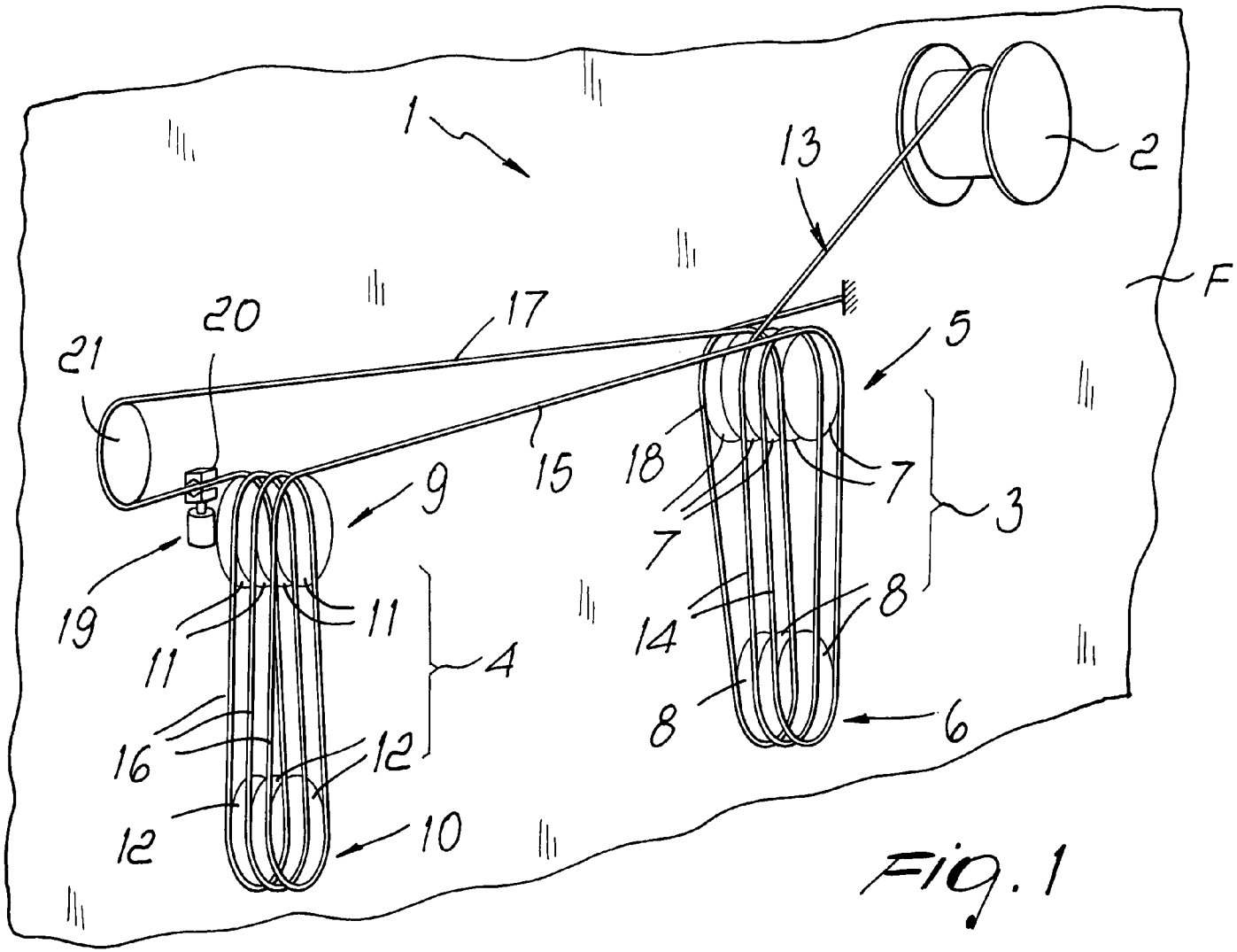
FIG. 1 is a schematic partial axonometric view of the lifting unit according to the invention.

With reference to the FIGURE, the reference numeral 1 generally designates a lifting unit.

The unit 1 comprises a supporting frame F, for a motorized winch 2 and for at least one first tackle 3 and one second tackle 4, said first tackle being interposed between said second tackle and the winch 2.

The winch 2 is associated with conventional means for rotational actuation about its own axis in both directions, which are usually of the electric or hydraulic type.

The first tackle 3 comprises a fixed block 5, which is supported by the frame, and a movable block 6, which is arranged below the other block, each block comprising at least one respective pulley 7 and 8.

The second tackle 4 comprises a fixed block 9, which is supported by the frame, and a movable block 10, which is arranged below the other block, each block comprising at least one respective pulley 11 and 12.

The pulleys 7 and 11 are freely supported by the frame.

The pulleys 7, 8, 11 and 12 are shown in phantom lines in the FIGURE.

The unit 1 comprises a flexible element 13, such as a cable, a chain or other flexible elements capable to withstand heavy loads, in which a first end is rigidly coupled to the winch 2 and a second end, which lies opposite the preceding end, is rigidly coupled to the frame and wound around the pulleys 7, 8, 11 and 12.

According to the invention, the fixed block 5, the movable block 6, the fixed block 9 and the movable block 10 respectively comprise at least four pulleys 7, at least two pulleys 8, at least two pulleys 11 and at least one pulley 12.

Therefore, the flexible element 13 is wound around the pulleys 7, 8, 11 and 12 so as to form, starting from the first end and going toward the second end, at least one initial loop 14 around the first tackle 3, an outgoing portion 15 from the first tackle 3 to the second tackle 4, at least one intermediate loop 16 around the second tackle 4, a return portion 17 from the second tackle 4 to the first tackle 3, and at least one end or final loop 18 around said first tackle.

Each one of the loops 14, 16 and 18 comprises two lengths of flexible element 13.

The winch 2 is usually provided with safety systems, such as for example brakes or hydraulic control systems, which prevent its accidental rotation in the direction of the unwinding of the flexible element 13.

Further, the unit 1 has means 19 for temporarily locking the sliding of the flexible element 13, which cooperate with said element along the return portion 17.

The temporary locking means 19 comprise at least one clamp 20, which is supported by the frame and can be actuated between an open configuration, in which the flexible element 13 can slide, and a closed configuration, in which it clamps said element so as to prevent its sliding between the first tackle 3 and the second tackle 4.

The clamp 20 can be actuated mechanically or hydraulically or pneumatically or electrically.

Preferably, the unit 1 comprises a guiding pulley 21, which is freely supported by the frame and is associated with the flexible element 13 along the return portion 17.

In the illustrated embodiment, the clamp 20 is interposed between the fixed block 9 and the guiding pulley 21, but it might also be arranged between said return pulley and the fixed block 5.

The movable blocks 6 and 10 are associated with respective elements for gripping a load to be moved, which are not shown and are constituted for example by hooks, slings or others.

Preferably, to allow the unit 1 to have an optimum performance, the sum of the number of initial loops 14 and of end or final loops 18 should be equal to the number of intermediate loops 16 and therefore there should be at least two intermediate loops 18.

In a preferred embodiment, shown in the FIGURE, the blocks 5, 6, 9 and 10 respectively comprise five pulleys 7, three pulleys 8, four pulleys 11 and three pulleys 12, and the flexible element 13 is wound around them so as to form two initial loops 14, three intermediate loops 16 and an end loop 18.

The pulleys 7, 8, 11 and 12 of each block, respectively 5, 6, 9 and 10, are mutually coaxial.

It should be noted that the number of pulleys 7, 8, 11 and 12 can vary depending on the nominal capacity of the unit 1.

Preferably, the unit 1 is provided with actuation and control means for remotely controlling the actuation of the winch 2 and of the camp 20 on the part of an operator, which are of a conventional type.

Said control means may provide, for example, a remote control, a cable control or a keypad.

The unit 1 can be applied advantageously to a known type of lifting machine, such as cranes, bridge cranes, and particularly equipment for lifting, moving and depositing watercraft, conventionally used at port shores and in shipyards.

During the lifting or deposition of a load, with the clamp 20 in the open configuration, the winch 2 is turned so as to wind or unwind the flexible element 13 thereon, so as to activate the upward or downward movement of the movable blocks 6 and 10 and of the corresponding grip elements.

In the unladen movement of the movable blocks 6 and 10 for their lifting, by turning the winch 2 in the direction for winding the flexible element 13 thereon, with the clamp 20 in the open configuration, the movable block 6 is moved upward, while the movable block 10 does not alter its elevation due to friction.

By closing the clamp 20, the configuration of the first tackle 3 instead remains unchanged, since the length of the portion of flexible element 13 that is comprised between the clamp 20 and the second end of said element cannot be changed, while the movable block 10 moves upward.

More generally, the operation of the unit 1 with the clamp 20 in the closed configuration allows to control safely and effectively the relative movements of the movable blocks 6 and 10.

For the movement of loads having limited dimensions and weights, it is possible to lift and lower just the movable block 6, keeping the clamp 20 in the closed configuration.

In practice it has been found that the described invention achieves the intended aim and objects.

In particular, the lifting unit according to the invention is safer and more efficient than known ones, while being simpler and cheaper.

The invention thus conceived is susceptible of numerous modifications and variations, all of which are within the scope of the appended claims.

All the details may further be replaced with other technically equivalent ones.

In practice, the materials used, as well as the shapes and the dimensions, may be any according to requirements without thereby abandoning the scope of the protection of the appended claims.

The disclosures in Italian Patent Application No. MO2004A000093 from which this application claims priority are incorporated herein by reference.

What is claimed is:

1. A lifting unit, comprising: a frame; a motorized winch; at least one first tackle; at least one second tackle, said first tackle being interposed between said second tackle and said winch, said first and second tackles and winch being supported at said frame; two blocks, provided at each of said first and second tackles, a fixed one and a movable one; at least one pulley, provided at each one of said blocks; a flexible element, having a first end connected to said winch and being wound around said pulleys so as to form at least one initial loop around said first tackle, an outgoing portion from said first tackle to said second tackle, at least one intermediate loop around said second tackle, a return portion from said second tackle to said first tackle, and at least one end loop around said first tackle, a second end of said flexible element being connected to said frame; and locking means which act at said flexible element along said return portion for temporarily locking sliding of said flexible element.

2. The unit of claim 1, wherein said fixed and movable blocks of said first tackle comprise at least four and at least two of said pulleys, respectively, and said fixed and movable blocks of said second tackle comprise at least two and at least one of said pulleys, respectively.

3. The unit of claim 1, wherein said locking means comprises at least one clamp, which is supported by said frame and is actuatable between an open configuration, in which said flexible element is allowed to slide, and a closed configuration, in which the clamp clamps said element so as to prevent sliding thereof between said first and second tackles.

4. The unit of claim 3, wherein said clamp is provided with an actuation selected among mechanical, hydraulical, pneumatical and electrical actuations.

5. The unit of claim 3, comprising at least one guiding pulley, which is freely supported by said frame and is associated with said flexible element along said return portion.

6. The unit of claim 5, wherein said flexible element is of a type selectable among a cable, chain and other flexible elements adapted to withstand loads.

7. The unit of claim 1, comprising load gripping elements that are associated with said movable blocks.

8. The unit of claim 1, wherein said loops are provided in an amount such that a sum of a number of said initial and final loops is equal to a number of said intermediate loops.

9. The unit of claim 8, comprising at least two of said intermediate loops.

10. The unit of claim 1, wherein said fixed and movable blocks of said first tackle comprise, respectively, five and three of said pulleys, and the fixed and movable blocks of said second tackle, respectively, comprise four and three of said pulleys, said flexible element being wound around said pulleys so as to form two of said initial loops, three of said intermediate loops, and one of said end loops.

11. The unit of claim 1, further comprising control and actuation means operatable by an operator for actuating said winch and said locking means.

12. The unit of claim 11, wherein said control and actuation means are provided with a remote control.

* * * * *